US005960906A

United States Patent [19]

Henderson

[11] Patent Number: 5,960,906

[45] Date of Patent: Oct. 5, 1999

[54] MOVABLE LADDER SUPPORT ASSEMBLY

[76] Inventor: Arlanders Henderson, 540 N. Los Robles, Pasadena, Calif. 91101

[21] Appl. No.: 09/063,220

[22] Filed: Apr. 20, 1998

[51] Int. Cl.[6] ..... A63C 5/08

[52] U.S. Cl. ..... 182/180.2; 182/13; 182/36; 182/38; 182/84

[58] Field of Search ..... 182/13, 36, 27, 182/38, 39, 80, 84, 69.4, 179.1, 180.1, 180.2, 180.3, 186.7, 186.8, 186.9, 207, 210; 248/238, 210

[56] References Cited

U.S. PATENT DOCUMENTS

| | | | |
|---|---|---|---|
| 383,449 | 5/1888 | Eiden | 182/13 |
| 740,382 | 9/1903 | Oestreicher | 182/13 |
| 907,402 | 12/1908 | Prouty | 182/39 X |
| 2,902,110 | 9/1959 | Eickholdt | 182/13 |
| 2,964,122 | 12/1960 | Funk et al. | 182/180.3 |
| 3,059,721 | 10/1962 | Straw | 182/13 |
| 3,124,213 | 3/1964 | Jorsey | 182/13 |
| 3,327,810 | 6/1967 | Johnson et al. | 182/180.2 X |
| 3,429,398 | 2/1969 | Reynolds et al. | 182/13 |
| 4,232,759 | 11/1980 | Jacobs | 182/39 |
| 4,493,392 | 1/1985 | Alimbau | 182/27 |
| 4,646,877 | 3/1987 | Whan | 182/38 |
| 4,756,384 | 7/1988 | Maddox | 182/18 |
| 4,899,847 | 2/1990 | Lufkin | 182/13 |

*Primary Examiner*—Daniel P. Stodola
*Assistant Examiner*—Bruce A. Lev
*Attorney, Agent, or Firm*—Goldstein & Canino

[57] ABSTRACT

A ladder support system, comprising a free-standing frame having an upper and lower horizontal member, and a ladder that is supported on the upper horizontal member and lower horizontal member. The frame further has a pair of ends which each have two legs joined by a top joint which forms an acute angle between the two legs which are both perpendicular to the upper horizontal member, which is also attached to the top joint. The upper horizontal member is parallel to the lower horizontal member. The ladder has wheel assemblies which engage the upper horizontal member and lower horizontal member so that the ladder may move laterally along the frame. A movement mechanism comprises a pair of end pulleys located at the ends, and a rope having a pair of rope extremities. The rope is threaded through the end pulleys with the rope extremities available to a workmen on the ladder, so that the workmen can move the ladder laterally along the frame without climbing down the ladder.

5 Claims, 3 Drawing Sheets

MOVABLE LADDER SUPPORT ASSEMBLY

BACKGROUND OF THE INVENTION

The invention relates to a movable ladder support assembly. More particularly, the invention relates to a ladder support, which has a frame that is capable of supporting a ladder adjacent to a work area, and of allowing the ladder to slide laterally along the work area.

A ladder is a necessary tool in many trades. Any job which requires work to be conducted at an uncomfortable or unreachable height requires that one use a ladder. However, the nature of many of these jobs require that the worker frequently stop working as the work progresses, to climb down the ladder in order to move the ladder laterally along a building or other work area. For example, painters must often use a ladder to reach higher areas of a wall, but must also continuously move the ladder along the wall to complete painting the wall.

Some ladders have provisions for moving along a wall. U.S. Pat. No. 4,232,759 is a mobile ladder which is capable of moving along a wall by means of a track structure that is clamped to the roof. However, Jacobs is a system which requires a pair of tracks to be mounted to the roof, and a third track mounted to the ground. It seems that if these tracks are not carefully aligned when mounted, they can cause the ladder to derail, with disastrous consequences.

U.S. Pat. No. 4,899,847 to Lufkin discloses a mobile support which comprises a pair of rollers that mount in two troughs on the ground, and a third roller which engages the wall. In addition to being problematic to set up, Lufkin is undesirable for applications where it is undesirable to have a roller wheel actually touch the wall, such as while painting the wall.

While these units may be suitable for the particular purpose employed, or for general use, they would not be as suitable for the purposes of the present invention as disclosed hereafter.

SUMMARY OF THE INVENTION

It is an object of the invention to produce a ladder support system which effectively supports a ladder along a wall or along a work area, and allows the ladder to be slid laterally along the work area as the work progresses. Accordingly, the ladder has rollers which engage the frame and allow the ladder to move along the frame.

It is another object of the invention to provide a ladder support system which supports a ladder without requiring actual contact with a wall. Accordingly, a free-standing A-type frame is provided which can fully support the ladder and the workmen, without requiring the support of a nearby wall.

It is a further object of the invention to provide a ladder support system which is adjustable in height, to allow work to progress at different heights above the ground surface. Accordingly, the A-type frame has telescoping sections which allow adjustment of the height of the A-type frame if telescoped uniformly, and allows adjustment of the ladder angle if not telescoped uniformly.

It is a still further object of the invention to provide a ladder support system which allows the ladder to be moved laterally by the workmen without requiring that the workmen climb down the ladder. Accordingly, a pulley system is provided which allows the workmen to move the ladder laterally by pulling upon the rope.

The invention is a ladder support system, comprising a free-standing frame having an upper and lower horizontal member, and a ladder that is supported on the upper horizontal member and lower horizontal member. The frame further has a pair of ends which each have two legs joined by a top joint which forms an acute angle between the two legs which are both perpendicular to the upper horizontal member, which is also attached to the top joint. The upper horizontal member is parallel to the lower horizontal member. The ladder has wheel assemblies which engage the upper horizontal member and lower horizontal member so that the ladder may move laterally along the frame. A movement mechanism comprises a pair of end pulleys located at the ends, and a rope having a pair of rope extremities. The rope is threaded through the end pulleys with the rope extremities available to a workmen on the ladder, so that the workmen can move the ladder laterally along the frame without climbing down the ladder.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
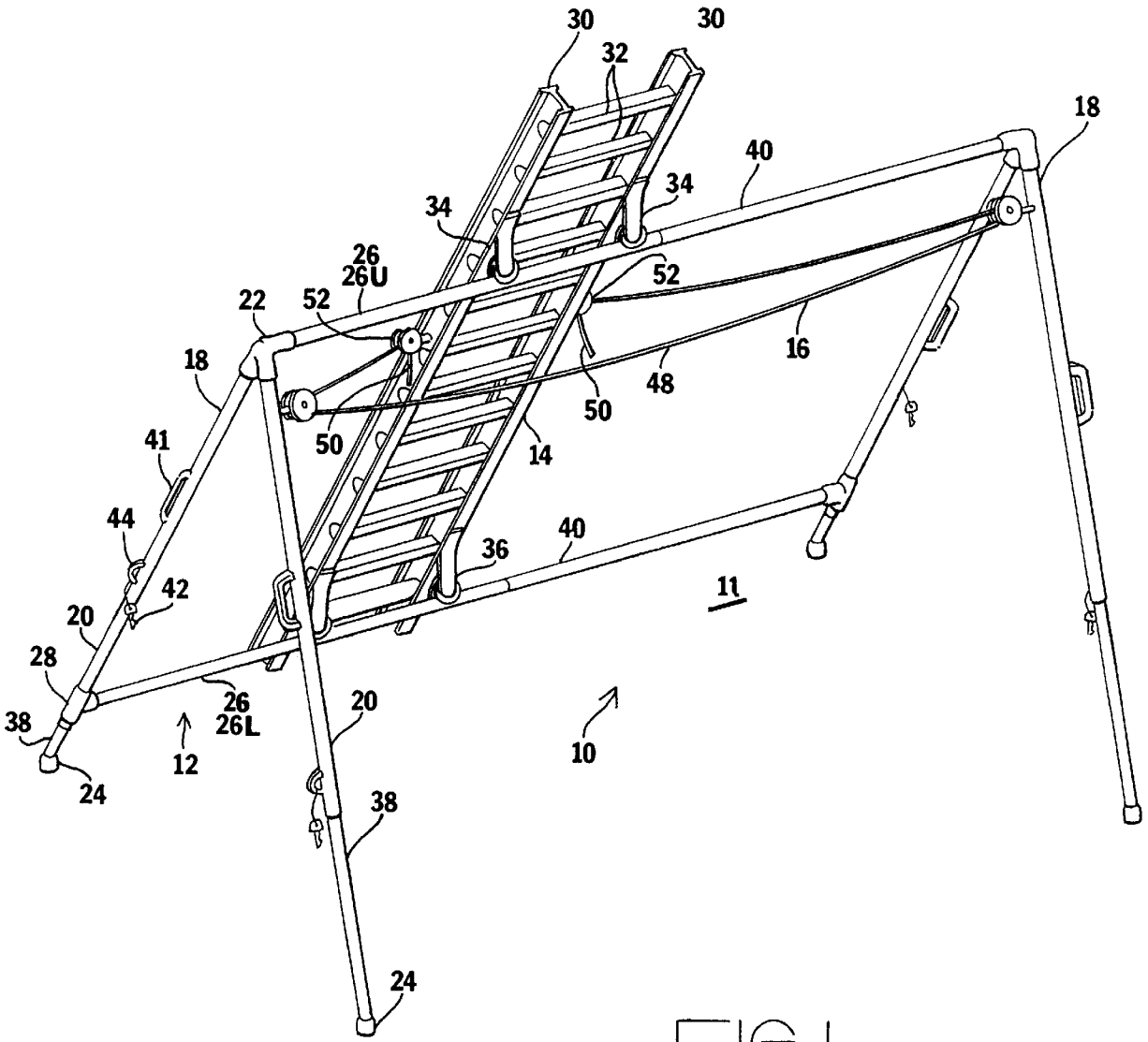
FIG. 1 is a diagrammatic perspective view, illustrating the ladder support system per se.

FIG. 1 illustrates a ladder support system 10 resting on a ground surface 11, comprising a frame 12 and a ladder 14. A movement mechanism 16 allows the ladder 14 to move laterally along the frame 12.

The frame 12 has a pair of ends 18 which each include a pair of legs 20, and a top joint 22 which connects the legs 20 at an acute angle, which is preferably ten to sixty degrees. The legs 20 each have a base 24 opposite the top joint 22, which engages the ground surface 11. The ends 18 are connected with a pair of horizontal members 26 which extend parallel to each other, and parallel to the ground surface 11. The horizontal members 26 meet the legs 20 at a right angle.

The horizontal members 26 include an upper horizontal member 26U and a lower horizontal member 26L. The upper horizontal member 26U is preferably joined to the ends 18 with the top joint 22, which is preferably a three tube connector, wherein an acute angle is formed between two of the tubes, and those two tubes form a right angle with the third tube, as illustrated. The lower horizontal member 26L is connected to the ends 18 with a lower connector 28. The lower connector is preferably a three tube T-connector, wherein two tubes are separated by one hundred eighty degrees, one of the legs 20 extends through those two tubes, which form a right angle with the remaining tube. Said remaining tube is attached to the lower horizontal member 26L.

The ladder 14 comprises two main rails 30 and a plurality of rungs 32. An upper wheel assembly 34 and a lower wheel assembly 36 are mounted to each of the main rails 30. The upper wheel assembly 34 and lower wheel assembly 36 on each of the main rails 30 are separated by a distance which allows them to engage the upper horizontal member 26U and lower horizontal member 26L, respectively. Thus, the ladder is capable of lateral movement on the frame by means of the upper wheel assemblies 34 and lower wheel assemblies 36 traveling on the upper horizontal member 26U and lower horizontal member 26L.

The legs 20 each have telescoping leg sections 38, which allow the entire frame 12 to be raised to allow work at greater heights, or for varying the angle of the entire frame 12 with respect to the ground surface 11. In addition, the horizontal members 26 can have telescoping horizontal sections 40, for extending or collapsing the lateral length of the frame 12, depending on the size of the work area. Each leg 20 further has a handle 41 near the top joint 22 to allow the entire frame to be easily moved when necessary.

The telescoping sections 38 and 40 may be locked in place with a plurality of keys 42, provided at different locations on the frame. The keys 42 may be removably attached at key storage hooks 44, which make the keys 42 conveniently available when needed, and store them when not in use.

The movement mechanism 16 includes a pair of end pulleys 46, one of which is located at each of the ends, attached to one of the legs 20 thereat. A rope 48 having rope extremities 50 is strung through both of the end pulleys 48, wherein the rope extremities 50 are each available at one of the main rails of the ladder. Thus, the ladder can be moved laterally by pulling upon one of the rope extremities 50. Preferably, a pair of main rail pulleys 52 may be provided at the main rails 30, to deflect the rope 48 approximately ninety degrees, so that it can be more easily pulled by the person while on the ladder. Preferably each of the rope extremities 50 should be knotted, so that they cannot be inadvertently pulled through one of the main rail pulleys 52. In general, the rope 48 should be threaded so that when the ladder is just adjacent to one of the ends 18, then the rope extremity 50 nearest that end should be at it's associated main rail pulley 52.

Figure 2:
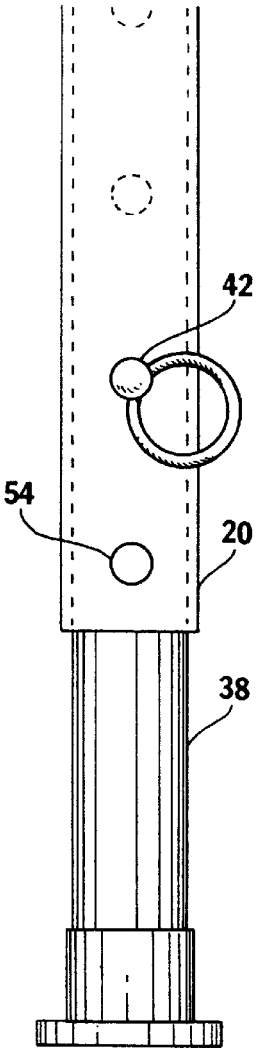
FIG. 2 is an elevational view, illustrating one of the telescoping legs retracted, and locked in place with a key.
Figure 3:
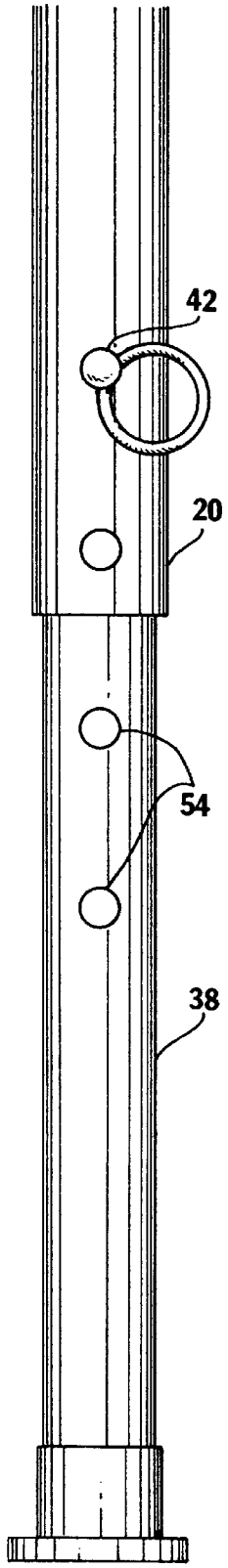
FIG. 3 is an elevational view, illustrating one of the telescoping legs extended, and locked in place with the key.

Referring to FIG. 2 and FIG. 3, the telescoping sections 38 of one of the legs 20 is illustrated in retracted and expanded positions, respectively. Adjustment is provided by locking holes 54 in both the leg 20 and the telescoping section 38. Different locking holes 54 are engaged with the key 42 to provide different combined lengths for the leg 20 with the telescoping section 38.

Figure 4:
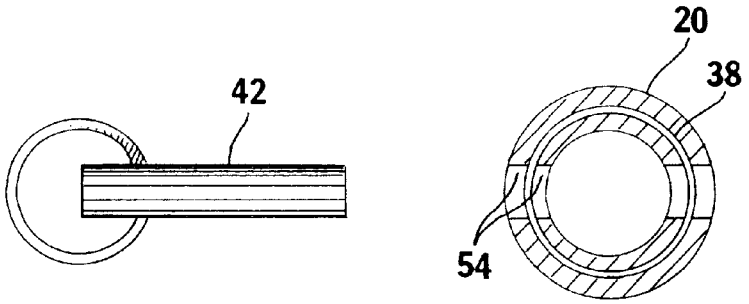
FIG. 4 is a cross sectional view, illustrating the key being used to lock one of the telescoping legs in place.

Referring to FIG. 4, the locking holes 54 are matched between the leg 20 and the telescoping section 38. Then, the key 42 is inserted to fix the relative position of the leg 20 and telescoping section 38.

Figure 5:
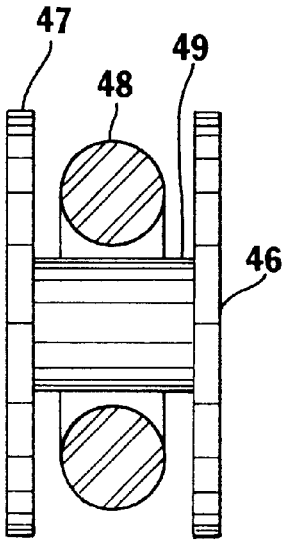
FIG. 5 is a cross sectional view, illustrating one of the pulleys.
Figure 6:
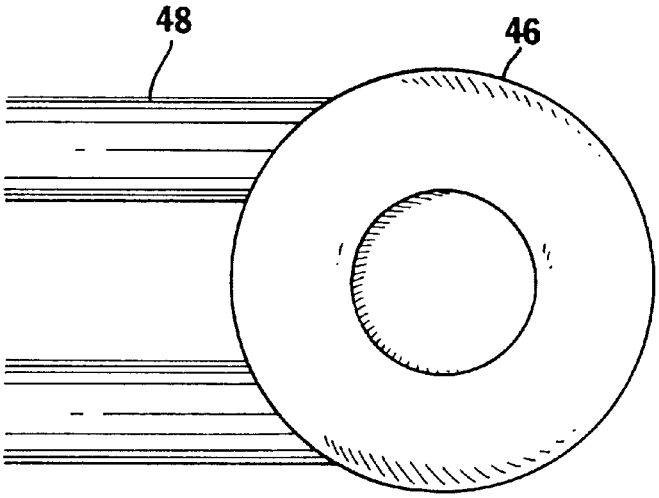
FIG. 6 is an front elevational view, illustrating one of the pulleys with the rope tensioned therethrough.

FIG. 5 and FIG. 6 illustrates one of the end pulleys 46, which each have a pair of flanges 47 extending outward from a central shaft 49. The flange 47 retains the rope around the central shaft 49, and prevents the rope 48 from falling off the shaft 49, as long as the rope 48 is tensioned.

In conclusion, herein is presented a ladder support system which includes a free-standing frame, which is capable of supporting a ladder, such that the ladder may be moved by a worker laterally along the frame, without requiring that the worker first climb down the ladder.

What is claimed is:

1. A ladder support system, for use on a ground surface, comprising:

a frame, the frame comprising a pair of ends having a pair of legs, each leg having a base, and a top joint that creates an acute angle between the legs, each leg also having a telescoping section for adjusting the distance between the base and top joint for varying the height of the ladder, said frame further comprising an upper horizontal member and lower horizontal member, attached to one of the legs, extending between the ends, the frame capable of freely standing with the bases upon the ground surface without support from a wall;

the top joint being a three tube connector wherein two of the tubes are attached to the legs, and the third tube is attached to the upper horizontal member;

a ladder, having a pair of main rails, a plurality of rungs extending between the main rails, a pair of upper wheel assemblies, and a pair of lower wheel assemblies, the upper wheel assemblies engaging the upper horizontal member and the lower wheel assemblies engaging the lower horizontal member so that the ladder can move laterally along the frame;

a movement mechanism, for allowing a worker to pull the ladder laterally along the frame, comprises a pair of end pulleys, each end pulley attached to one of the ends, and a rope threaded through the end pulleys, the rope having a pair of rope extremities which are available to the worker on the ladder to move the ladder laterally along the frame by pulling on the rope ends.

2. The ladder support system as recited in claim 1, further comprising a lower joint for attaching the lower horizontal member to one of the legs, the lower joint being a T-shaped connector.

3. The ladder support system as recited in claim 2, further comprising handles on the legs for moving the ladder support system.

4. The ladder support system as recited in claim 3, further comprising a pair of main rail pulleys provided at the main rails, to deflect the rope approximately ninety degrees, so that the rope extremities can be pulled by the worker while on the ladder.

5. The ladder support system as recited in claim 4, wherein the upper horizontal member and lower horizontal member are telescopic.

* * * * *